United States Patent [19]

Simson

[11] 3,944,033

[45] Mar. 16, 1976

[54] BAG HANDLE

[76] Inventor: Earl G. Simson, 1140 Webster Ave., New Rochell, N.Y. 10804

[22] Filed: Oct. 29, 1974

[21] Appl. No.: 518,311

[52] U.S. Cl. ..... 190/57; 190/58 R

[51] Int. Cl.[2] ..... A45C 13/26

[58] Field of Search ..... 16/110 R, 110.5, DIG. 41; 150/12; 190/57, 58

[56] References Cited

UNITED STATES PATENTS

| | | | |
|---|---|---|---|
| 2,273,442 | 2/1942 | Hedu | 190/57 |
| 2,398,436 | 4/1946 | Mason | 190/57 |
| 2,528,831 | 11/1950 | Jaffe | 190/57 |
| 3,115,228 | 12/1963 | Louik et al. | 190/57 |
| 3,530,962 | 9/1970 | Schneider | 190/58 R |

FOREIGN PATENTS OR APPLICATIONS

| | | | |
|---|---|---|---|
| 1,180,397 | 2/1970 | United Kingdom | 190/57 |

*Primary Examiner*—William Price
*Assistant Examiner*—Steven E. Lipman
*Attorney, Agent, or Firm*—Caesar, Rivise, Bernstein & Cohen

[57] ABSTRACT

A bag handle is provided which includes fastening elements for holding the handle elements together for ease of carrying. In addition, pivotable securement means for holding the handle to the side walls of the bag are provided which comprise a pair of molded straps for each handle, with each of the straps having a transversely extending opening at one end with a planar longitudinally extending slit extending from the opening. Each of the handle elements have bars formed at each end of the legs thereof which are journalled in the opening of the strap. The strap is directly connected to the side wall of the bag.

5 Claims, 5 Drawing Figures

FIG. 1
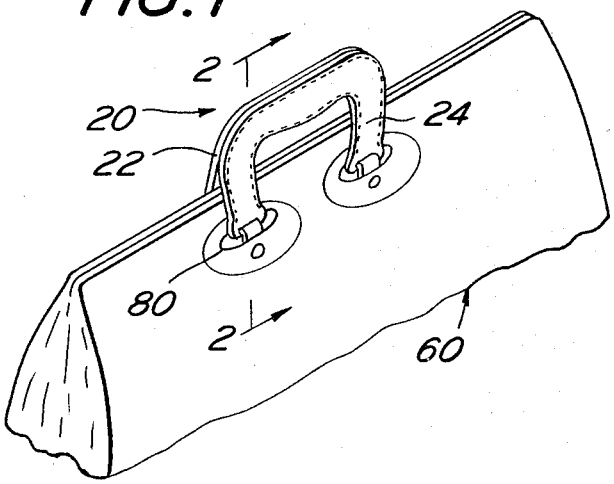
FIG. 2
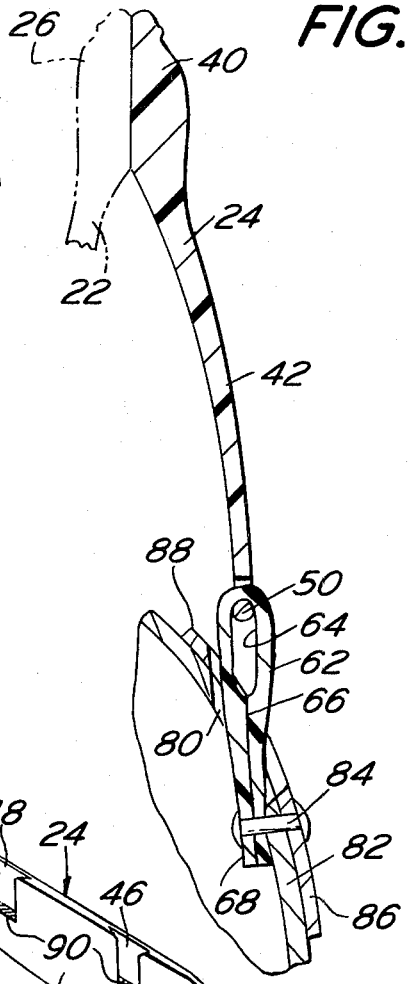
FIG. 5
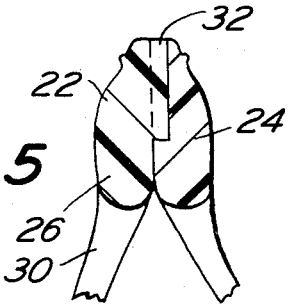
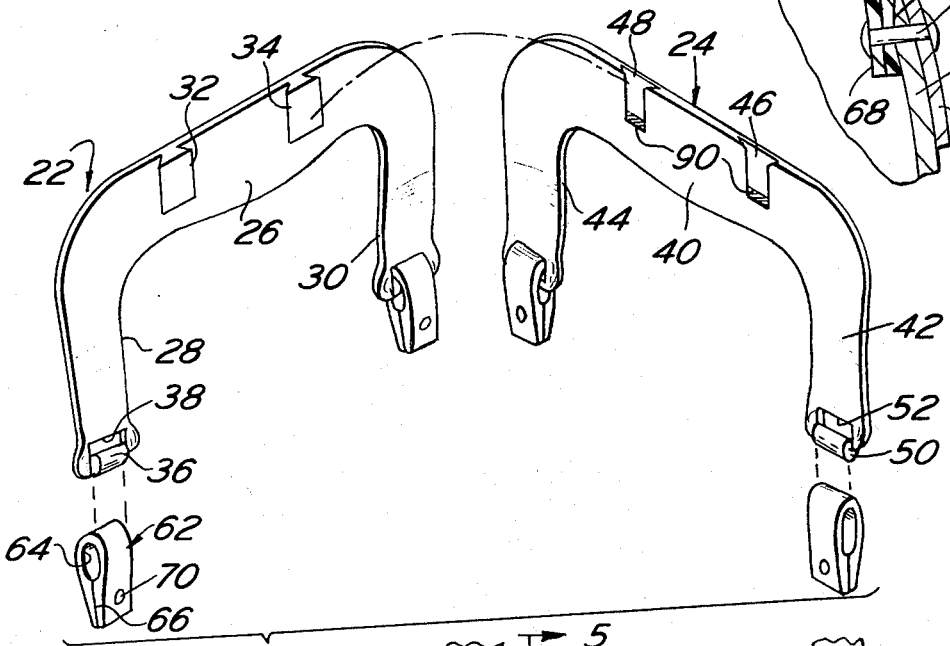
FIG. 3
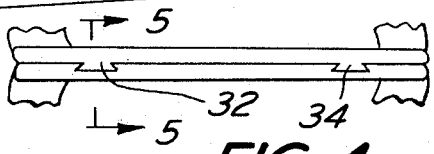
FIG. 4

BAG HANDLE

This invention relates generally to bag handles and more particularly to a molded handle which is inexpensively manufactured and is held together uniquely by releasable securement means.

The most common form of pivotable securement of a handle to the side wall of a luggage, club or athletic bag is a thick wire formed as a rectangle which has one end pivoted in the opening formed in the end of the handle and the other end of the link being journalled in an opening formed by a thin metal sheet having two large round discs which are connected together by a strap portion which is bent around the end of the link and forms a journal for the end of the link. The two circular portions of the metal sheet are then secured to the side wall of a bag by a fastener which is then punched through the side wall of the bag and through an opening which extends transversely through the plane of the metal sheet.

The disadvantages of such a pivotable connection are that the link must be formed after it has been inserted through the opening in the handle thereby causing an expensive step in the formation of the handle. Another disadvantage is that the metal sheets, because they are very thin, but rigid, cause breaking of the side walls of the bag at the periphery of the metal sheets.

It is therefore an object of the invention to overcome the disadvantages of the prior art.

Another object of the invention is to provide a new and improved handle having fastening elements for securing the handles together when the bag is carried for ease of handling.

Still another object of the invention is to provide a new and improved handle which includes improved pivotable securement means for attaching a handle to the side wall of a bag.

Yet another object of the invention is to provide a new and improved bag handle which is comprised of a pair of handle elements which are each molded and are therefore inexpensive to produce.

These and other objects of the invention are achieved by providing a bag handle which comprises a pair of U-shaped handle elements. Each of the elements include a gripping section which bridges a pair of leg members. Each of the leg members of each of the handle elements is pivotally secured to a side wall of the bag. One of the handle elements includes at least one dovetailed projecting member which extends transversely along the inside surface of the gripping section. The other of the handle elements includes at least one recess for receiving the dovetailed projecting members so that the handle elements are held together. The legs of the handle elements are secured to the side walls by a pair of molded straps. Each of the straps has a transversely extending opening at one end with a planar longitudinally extending slit extending from the opening. The slit causes a pair of legs in each of the straps. Each of the legs of the handle elements has integrally formed therein at their free end a bar. The bars of each of the handle elements are coaxial. Adjacent each of the bars formed at the end of the handles are openings which are provided to accomodate the portion of the straps surrounding the openings of the straps. The bars are journalled in the openings of the straps with the straps being secured to the side walls by a fastener extending transversely to the slit and extending transversely therethrough.

Other objects and many of the attendant advantages of this invention will be readily appreciated as the same becomes better understood by reference to the following detailed description when considered in connection with the accompanying drawings wherein:

FIG. 1 is a fragmentary perspective view of a bag embodying the invention;

FIG. 2 is an enlarged vertical sectional view taken along the line 2—2 in FIG. 1;

FIG. 3 is an exploded enlarged perspective view of the inside portions of the handle elements forming the handle embodying the invention;

FIG. 4 is a top plan view of the handles; and

FIG. 5 is an enlarged sectional view taken along the line 5—5 in FIG. 4.

Referring now in greater detail to the various figures of the drawings wherein like reference numerals refer to like parts, a bag handle embodying the present invention is generally shown at 20.

Bag handle 20 basically comprises a pair of handle elements 22 and 24.

As best seen in FIG. 3, handle element 22 is U-shaped and includes a thick elongated gripping section 26 which bridges a pair of integrally formed legs 28 and 30. As best seen in FIG. 5, the lower surface of the gripping section 26 is suitably rounded so that comfort in lifting is enhanced. Provided on the inside surface of the gripping section 26 is a pair of dovetailed projections 32 and 34. The dove tailed projections extend transversely along the inner surface of the gripping section 26.

Each of the legs 28 and 30 include an integrally formed bar at the end thereof. At the end of leg 28 bar 36 is formed which extends transversely to the length of leg 28 at the free end thereof. Adjacent bar 36 an opening 38 is provided which extends along the length of bar 36. The bar 36 is preferably of circular cross-section for ease of pivotability of the handle element 22. The free end of leg 30 of the handle element 22 is similarly formed with the bar at the end thereof having an adjacent opening similar to opening 38.

Handle element 24 includes a thick elongated gripping section 40 and a pair of integrally formed legs 42 and 44. The handle element 24 is also U-shaped and includes a pair of recesses 46 and 48 in the inside surface of the gripping section 40. The recesses 46 and 48 are complimentary to the outer surface of the dove tailed projections 32 and 34, but slightly larger so that the recesses 46 and 48 can receive the dovetailed projections 32 and 34, respectively.

The legs 42 and 44 are formed similarly to legs 28 and 30 of handle element 22 and include a bar 50 of circular cross-section which is formed adjacent an opening 52.

Each of the handle elements 22 and 24 are secured to one of the side walls of a bag 60 by a pair of straps 62. As best seen in FIG. 2, each strap includes an elongated opening 64 which extends transversely to the length of the strap 62. The opening 64 is also elongated longitudinally so that, as will hereinafter be seen, the handles can slide with respect to the straps. A planar slit 66 extends longitudinally of strap 62 from opening 64 to the end 68 of the strap. As best seen in FIG. 3, the straps 62 include an opening 70 which extends perpendicular to the slit 66 through the end of strap 62 opposite that in which the opening 64 is provided. The straps 62 and the handle element 22 and 24 are preferably comprised of a moldable thermoplastic resin such as polyethylene or polypropylene.

Bag 60 is preferably an athletic bag which is preferably made of plastic, leather or vinyl. Each of the side walls includes a pair of openings 80 through which the legs of the straps 62 formed by slit 66 passes. The legs are secured against the side wall 82 of the bag by a suitable fastener such as rivet 84.

In addition, the side walls 82 of the bag 60 may also include a decorative and reinforcing patch 86 which is suitably secured about each of the openings 80. Each patch 86 includes an opening 88 which is aligned with opening 80.

In order to secure the handle 20 to a bag, each of a pair of straps 62 has a leg thereof pass through opening 38 of each of the legs of handle element 22. The bar 36 of each of the legs is thus journalled in an opening 64 of one of the straps 62. Straps 62 are then inserted through the openings 80 in one of the side walls of the bag 60 whereupon a fastening element is inserted through the openings 70 of the straps and secured to the side walls of the bag. Each of the handle elements is pivotable about a pair of the straps 62 through an axis running through the bars 36 in each of the bars in the handle element. The bars 36 of handle element 22 are coaxially aligned as are bars 50 of handle element 24.

After each of the handle elements are secured to an opposite side of the bag, the bag may be lifted by lifting the handle elements 22 and 24 against each other and moving handle element 22 to its uppermost position with respect to strap 62. The uppermost portion of the extent of movement of handle element 22 is defined by the upper end of the slot 64 of each of the straps with the bars 36 thereagainst. The projections 32 and 34 are then aligned with the top opening of recesses 46 and 48 and the projections are then slid therein. The projections 32 and 34 are snugly secured in openings 46 and 48, respectively, and are stopped at the lowermost end of the recesses 46 and 48 by bottom walls 90 which act as stop shoulders.

The securement of the projections 32 and 34 in openings 46 and 48, respectively, act to hold the handle gripping section together for ease of handling the bag. That is, the securement of the gripping sections together prevents the sliding and shifting of the gripping elements with respect to each other and thereby makes lifting of the handle more comfortable for the user.

The legs of the straps 62 are narrow. This prevents a large pivoting action with respect to the point at which the strap 62 is secured to the side walls 82 of the bag. Thus there is a much smaller tendency to cause breaking of the side walls of the bag. Moreover, the molded construction of the straps 62 provide a smooth journal for pivotability of the handle elements 22 and 24 about an axis through the bars 36 and 50, respectively. Also, the straps 62 facilitate securement of the handle elements to the side walls of the bag 60 and reduce the number of steps necessary in the construction of the pivoting section of the handle.

It is also contemplated in another embodiment of this invention that the securement means for holding the handles together may also be made in a hermaphroditic manner. In this alternative embodiment each of the handle elements 26 and 40 are identical. This is accomplished in the alternate embodiment by replacing one of the projections 34 by a recess like recess 46 or 48 and replacing recess 48 by a projection like projection 32 or 34.

The recesses provided in each of the handle elements of the alternate handle elements are not terminated by a lower wall 90 in view of the fact that the bottom wall 90 prevents mating of the handle elements to each other. Thus, the recess in each handle element extends along the complete inner surface of the handle portion. In this way, each of the handle elements would be identical and would therefore require a single projecting member and a single recess in both handle elements.

The handle elements are secured together in the alternate embodiment in the same manner as the handle elements 26 and 40. The alternate handle includes all of the advantages of handle 20.

Without further elaboration, the foregoing will so fully illustrate my invention that others may, by applying current or future knowledge, readily adapt the same for use under various conditions of service.

What is claimed as the invention is:

1. In combination with a bag having a pair of side walls capable of being opened and closed a bag handle comprising a pair of U-shaped handle elements, each of said elements including a gripping section which bridges a pair of leg members, both of said leg members of one of said handle elements being pivotable secured to one side wall of said bag, and both of said leg members of the other of said handle elements being pivotably secured to the other side wall of said bag, one of said handle elements including at least one dove-tailed projecting member which extends transversely along the inside surface of the gripping section, the other of said handle elements include at least one recess for temporarily receiving said dovetailed projecting member so that when said projecting member is received in said recess said handle elements are temporarily held together yet enabling the said projecting member to be removed from said recess, whereupon said handle elements are separated to enable the opening of said bag.

2. The bag handle of claim 1 wherein said legs of said handle elements are secured to said side walls by a pair of molded straps, each of said straps having a transversely extending opening at one end with a planar longitudinally extending slit extending from said opening, said slit forming a pair of legs in each of said straps, each of said legs of said handle elements having integrally formed therein at their free ends, a bar, the bars of each handle element being coaxial, adjacent each of said bars an opening is provided through which the portion of said straps surrounding said openings of said straps pass, said bars being journalled in the openings of said straps, said straps being secured to said side walls by a fastener extending transversely to said slit and extending transversely therethrough.

3. The bag handle of claim 1 wherein a pair of projecting members are provided on one of the handle elements and a pair of recesses are provided on the other of the handle elements, said gripping sections of said handle element being secured together by sliding said dovetailed projections into said recesses.

4. In combination with a bag having a pair of side walls, a bag handle comprising a pair of U-shaped handle elements, each of said elements including a gripping section which bridges a pair of leg members, both of said leg members of each of said handle elements being pivotably secured to a side wall of a bag, said legs of said handle elements being secured to said side walls by a pair of molded straps, said straps each including a fastening element to enable a self-holding releasable securement for directly holding said straps together, said strap elements being separable to enable the opening of said bag, each of said straps including a first portion extending through an opening in said side wall and secured to the inside surface of said side wall adjacent said opening and having a transversely extending opening at one end with a planar longitudinally extending slit extending from said opening, said slit forming a pair of legs in each of said straps, said legs abutting each other to form said first portion, each of said legs of said handle element having integrally formed therein at their free ends, a bar, the bars of each of said handle elements being coaxial, adjacent each of said bars an opening is provided through which the portion of straps surrounding said openings of said straps pass, said bars being journalled in the openings of said straps, said straps being secured to said side walls by a fastener extending transversely to said slit and extending transversely therethrough.

5. The bag handle of claim 4 wherein said openings in said straps are elongated longitudinally of said strap.

* * * * *